US006291373B1

(12) United States Patent
Sakaguchi et al.

(10) Patent No.: US 6,291,373 B1
(45) Date of Patent: Sep. 18, 2001

(54) POLISHED-PIECE HOLDER

(75) Inventors: Tooru Sakaguchi; Tsuneo Kawamura, both of Tokyo (JP)

(73) Assignee: Shin-Kobe Electric Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/152,823

(22) Filed: Sep. 14, 1998

(30) Foreign Application Priority Data

Oct. 20, 1997 (JP) ..... 9-286505
Feb. 27, 1998 (JP) ..... 10-046844
Jun. 1, 1998 (JP) ..... 10-150840

(51) Int. Cl.[7] ..... B32B 27/38

(52) U.S. Cl. ..... 442/156; 442/110; 442/117; 442/158; 442/168

(58) Field of Search ..... 442/110, 117, 442/156, 158, 168

(56) References Cited

U.S. PATENT DOCUMENTS 4,680,617 * 7/1987 Ross ..... 357/72
5,484,647 * 1/1996 Nakatani et al. ..... 428/209

FOREIGN PATENT DOCUMENTS 3-73265 3/1991 (JP) .
6-304859 11/1994 (JP) .
9-225816 9/1997 (JP) .
9-254026 9/1997 (JP) .

* cited by examiner

*Primary Examiner*—Terrel Morris
*Assistant Examiner*—Arti R. Singh
(74) *Attorney, Agent, or Firm*—Pearne & Gordon LLP

(57) ABSTRACT

A polished-piece holder capable of preventing a polished piece from taking scratches, being increased in wear resistance, thickness accuracy, warpage resistance and dimensional stability, and preventing a deterioration in polishing accuracy. The polished-piece holder includes a core layer and a wear-resistant surface layer laminated on at least one of front and rear surfaces of the core layer. The core layer is constituted of at least one thermosetting resin impregnated fibrous layer and the surface layer is likewise constituted of a thermosetting resin impregnated fibrous layer. The thermosetting resin impregnated fibrous layer constituting the surface layer is subject to heating and pressurizing, to thereby provide a prepreg wherein a non-woven aramid fiber substrate is impregnated with thermosetting resin.

7 Claims, 2 Drawing Sheets

POLISHED-PIECE HOLDER

BACKGROUND OF THE INVENTION

This invention relates to a polished-piece holder, and more particularly to a holder for holding a piece to be polished ("hereinafter referred to as "polished piece") such as a silicon wafer, a hard disc or the like.

Manufacturing of a silicon wafer, a hard disc or the like includes a step of polishing a surface thereof into a plane or flat shape. During the polishing step, a polished piece such as a silicon wafer, a hard disc or the like is held on a polished-piece holder called a wafer carrier or a disc carrier for plane polishing.

In general, a polished-piece holder is formed into a disc-like shape while being formed on an outer periphery thereof with a gear and is provided with at least one through-hole in which a polished piece is supportedly fitted. Polishing of the polished piece held in the polished-piece holder is carried out by arranging the polished-piece holder in a polishing apparatus so that the gear formed on the outer periphery thereof may be engaged with an internal gear and a sun gear of the polishing apparatus. Then, the sun gear of the polishing apparatus is rotated to cause planetary motion of the polished-piece holder. This permits a polishing cloth to polish a surface of the polished piece into a plane shape.

Conventionally, the polished-piece holder is constructed of a laminate formed by laminating a plurality of prepregs on each other and heating the laminated prepregs while applying a pressure thereto in a direction of lamination thereof. The prepregs each are made by impregnating a sheet-like fibrous substrate with thermosetting resin, followed by drying of the substrate. Such a laminate is generally used for electrical insulation. The laminates include a cotton cloth-phenolic resin laminate formed by laminating a plurality of prepregs each made by impregnating a fibrous substrate of a cotton cloth with phenolic resin on each other, a glass fiber woven fabric substrate-epoxy resin laminate formed by laminating a plurality of prepregs each made by impregnating a fibrous substrate of a glass fiber woven fabric with epoxy resin on each other, a glass fiber nonwoven fabric substrate-epoxy resin laminate formed by laminating a plurality of prepregs each made by impregnating a fibrous substrate of a glass fiber nonwoven fabric with epoxy resin on each other, a laminate formed by laminating a plurality of prepregs each made by a fibrous substrate of a glass fiber woven fabric with epoxy resin and a plurality of prepregs each made by impregnating a fibrous substrate of a glass fiber non-woven fabric with epoxy resin on each other, and the like. Of the laminates, the cotton cloth-phenolic resin laminate and glass fiber woven fabric substrate-epoxy resin laminate are typically used for the polished-piece holder.

Another polished-piece holder is disclosed in Japanese Patent Application Laid-Open Publication No. 304859/1994, which includes a core layer constituted of a prepreg made by impregnating a fibrous substrate of polyester with thermosetting resin such as epoxy resin or the like. Then, the core layer is formed on each of both surfaces thereof with a surface layer, which is constituted of a prepreg made by impregnating a glass fiber substrate with thermosetting resin. Also, the publication discloses a polished-piece holder having a core layer made of polyurethane resin.

Japanese Patent Application Laid-Open Publication No. 254026/1997 discloses a polished-piece holder of which at least an outer periphery is formed of a glass fiber substrate-epoxy resin laminate, a carbon fiber substrate-epoxy resin laminate or an aramid fiber substrate-resin laminate, to thereby enhance durability of a gear formed on the outer periphery. Unfortunately, the publication is silent concerning a structure of each of the laminates. Judging from the disclosure of the publication, the laminates each are supposed to be used for electrical insulation. In general, a laminate for electrical insulation does not substantially regard wear resistance as important, as compared with that for a polished-piece holder. Thus, the laminate for electrical insulation disclosed includes a surface layer made of a woven fabric substrate.

In general, a polished-piece holder is highly required to exhibit increased wear resistance, thickness accuracy, warpage resistance and dimensional stability. Also, it is recently required to exhibit increased quality and performance. In particular, it is required to exhibit properties of keeping a polished piece from taking deep scratches. Unfortunately, a laminate used for the conventional polished-piece holder fails to exhibit properties of preventing a polished piece from taking deep scratches, because it is inherently used for electrical insulation rather than holding of a polished piece.

SUMMARY OF THE INVENTION

The present invention has been made in view of the foregoing disadvantages of the prior art.

It is an object of the present invention to provide a polished-piece holder which is capable of exhibiting increased wear resistance, thickness accuracy and warpage resistance and preventing a deterioration in polishing accuracy while preventing a polished piece from taking deep scratches.

A polished-piece holder of the present invention includes a thermosetting resin impregnated fibrous layer constituting a surface layer thereof. The thermosetting resin impregnated fibrous layer is provided by subjecting a prepreg made by impregnating a nonwoven aramid fiber substrate with thermosetting resin to heating and pressurizing. More particularly, it is constructed into a laminated structure which includes a core layer and a wear resistant surface layer laminated on at least one of front and rear surfaces of the core layer. In the present invention, the thermosetting resin impregnated fibrous layer constitutes the surface layer and is formed by subjecting a prepreg made by impregnating the nonwoven aramid fiber substrate with thermosetting resin to heating and pressurizing. Aramid fiber is organic fiber increased in tensile strength as compared with common fiber such as cotton, glass fiber or the like. Also, aramid fiber is reduced in hardness, to thereby be soft as compared with inorganic fiber such as glass fiber. Thus, even when polishing operation is carried out on a polished piece while keeping aramid fiber accidentally or unexpectedly adhered to a surface of the piece, aramid fiber keeps the polished piece from taking deep scratches, to thereby prevent it from being defective. In particular, use of a nonwoven fibrous substrate as the aramid fiber substrate as in the polished-piece holder reduces directionality of a variation in dimensions of the polished-piece holder when it is swollen. A woven fabric is different in strength between a warp direction thereof and a weft direction thereof, to thereby be increased in directionality of a dimensional variation thereof. Also, use of a nonwoven fibrous substrate as the aramid fiber substrate prevents a weaving pattern from appearing on a surface of the polished-piece holder when it is worn. Appearance of a weaving pattern on the surface of the polished-piece holder causes an increase in surface roughness of the polished-piece holder, to thereby render flowing of a slurry of a polishing agent nonuniform, leading to a deterioration in polishing accuracy. On the contrary, use of a nonwoven aramid fiber substrate prevents a weaving pattern of the fibrous substrate from appearing on the surface of the polished-piece holder, to thereby keep surface roughness of the polished-piece holder from being increased, even when the fibrous substrate partially appears on the surface of the polished-piece holder due to wearing of the surface of the holder. This keeps flowing of a slurry of a polishing agent from being nonuniform, to thereby eliminate a deterioration in polishing accuracy of the polished-piece holder.

The thermosetting resins impregnated in the aramid fiber substrate may include phenolic resin, epoxy resin, polyester, polyimide and the like. Thermosetting resin relatively increased in heat resistance such as phenolic resin or polyimide which has a moiety such as a benzene nucleus or the like which does not contribute directly to bonding incorporated at a high density in a molecular skeleton thereof is relatively decreased in bonding or adhesive properties although it is hard, so that it tends to generate peeling between the aramid fibrous substrate and the resin or breakage and wearing of the resin during polishing operation. Thus, epoxy resin is preferably used as the thermosetting resin. In order to minimize fragility or brittleness of the epoxy resin, a flexibility providing agent such as rubber is preferably added to the epoxy resin to modify it, resulting in providing flexible epoxy resin which exhibits flexibility after curing as well.

The aramid fibers includes para-aramid fiber and meta-aramid fiber. Para-aramid fiber is increased in mechanical properties such as tensile strength and modulus, to thereby restrain wearing of the polished-piece holder, leading to an increase in durability thereof, as compared with meta-aramid fiber. Also, para-aramid fiber is reduced in moisture absorption as compared with meta-aramid fiber, to thereby be suitable for use in a moist environment. Thus, it is preferable that the aramid fiber substrate is mainly constructed of para-aramid fiber. Para-aramid fibers include poly-p-phenylene terephthalamide fiber and poly-p-phenylene diphenyl ether terephthalamide fiber, both of which may be commercially available.

A content of para-aramid fiber in the polished-piece holder is preferably 17% by weight or more, because it increases strength of the polished-piece holder, to thereby restrain wearing of a gear section thereof, leading to an increase in durability of the polished-piece holder.

The core layer may be constructed into any desired structure. Nevertheless, formation of at least one thermosetting resin impregnated layer into the core layer permits the polished-piece holder to be readily manufactured using an installation for manufacturing a laminate for electrical insulation. Also, construction of at least one thermosetting resin impregnated fibrous layer into the core layer permits the number of layers to be determined or selected as desired, to thereby be readily accommodated to a desired thickness of a polished piece such as a silicon wafer, a hard disc or the like. The thermosetting resin impregnated fibrous layer for the core layer may be formed of either a prepreg made by impregnating a glass fiber substrate in the form of a woven fabric with thermosetting resin or a prepreg made by impregnating a polyester fiber substrate with thermosetting resin. In particular, when the thermosetting resin impregnated fiber layer for the core layer is formed of the prepreg made by impregnating the polyester fiber substrate with thermosetting resin, the polished-piece holder is substantially decreased in warpage as compared with that made of any other fibrous substrate. In particular, use of the polyester fiber substrate in the form of a woven fabric therefor significantly enhances the advantage. Also, formation of the prepreg made by impregnating the polyester fiber substrate with thermosetting resin into the thermosetting resin impregnated fibrous layer for the core layer minimizes occurrence of deep scratches on a polished piece, as compared with formation of the prepreg made by impregnating the glass fiber substrate in the form of a woven fabric with thermosetting resin into the core layer. This would be for the reason that the glass fibers are harder than the polyester fibers.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE INVENTION

Figure 1:
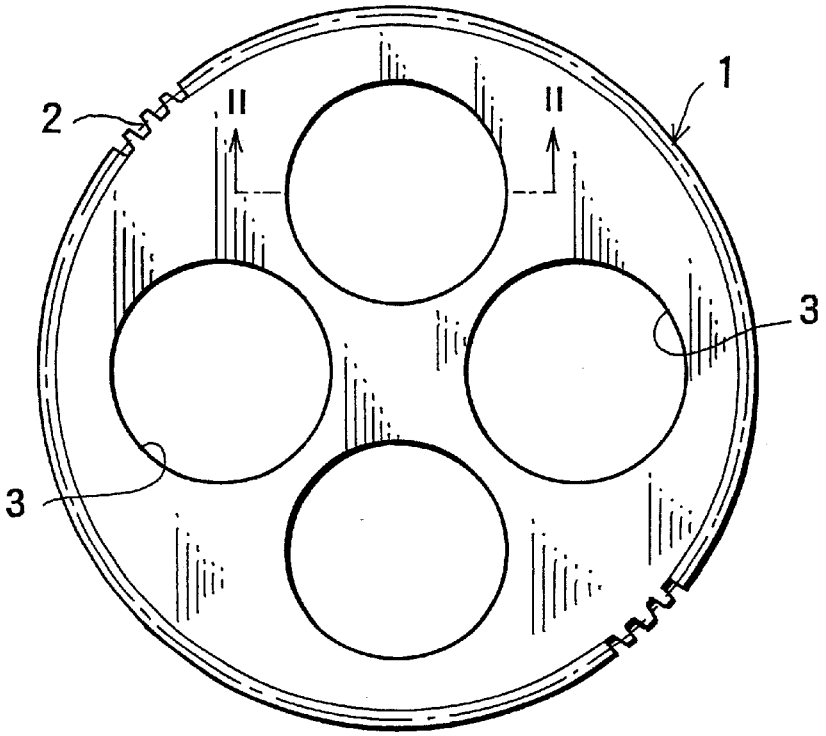
FIG. 1 is a plan view showing a polished-piece holder of Example 1 of the present invention.

The following fibrous substrates each were provided for manufacturing a polished-piece holder for a test.

(1) Aramid fiber substrate PA1

For manufacturing of the aramid fiber substrate PA1, a para-aramid fiber chop constituted of poly-p-phenylene 3, 4-diphenyl ether terephthalamide of 1.5 D (denier) in fineness and 3 mm in fiber length and a chop constituted of meta-aramid fiber of 3 D in fineness, 6 mm in fiber length and 280° C. in softening point were dispersed in water, to thereby prepare a dispersion.

In the illustrated embodiment, para-aramid fiber sold under a tradename "Technora" by TEIJIN LTD. was used for the para-aramid fiber chop and meta-aramid fiber sold under a tradename "Conex" by TEIJIN LTD. was used for the meta-aramid fiber chop. Then, the dispersion was subject to paper making to prepare a nonwoven sheet in which the two kinds of fiber were mixed together. Then, the sheet was sprayed with a water-soluble epoxy resin binder having a glass-transition temperature of 110° C. and then subject to drying by heating, to thereby obtain a nonwoven fabric of 60 $g/m^2$ in unit weight. A ratio by weight among the para-aramid fiber, meta-aramid fiber and resin binder was 85/5/10. Then, the nonwoven fabric was passed between a pair of thermal rolls, to thereby be subject to compression while being heated, so that the meta-aramid fiber was fusion-bonded to the para-aramid fiber, to thereby obtain the nonwoven aramid fiber substrate PA1.

(2) Aramid fiber substrate PA2

An aramid fiber substrate PA2 was made in substantially the same manner as the aramid fiber substrate PA1 described above, except that a para-aramid fiber chop was formed of poly-p-phenylene terephthalamide in place of poly-p-phenylene 3, 4-diphenyl ether terephthalamide.

(3) Aramid fiber substrate PA3

An aramid fiber substrate PA3 was manufactured in the same procedure as that for the aramid fiber substrate PA1 described above, except that it was a nonwoven fabric of aramid fiber made of only meta-aramid fiber chop used in manufacturing of the aramid fiber substrate PA1.

(4) Polyester fiber substrate ES1

A polyester fiber substrate ES1 was a woven fabric having a weaving density of 48 in warp and 48 in weft and a unit weight of 130 g/m$^2$. A polyester fiber substrate sold under tradename of "BKE Poplin" by ASAHI CHEMICAL INDUSTRY CO., LTD. was used as the polyester fiber substrate ES1.

(5) Polyester fiber substrate ES2

A nonwoven polyester fabric of 70 g/m$^2$ in unit weight which is sold under a tradename "EPM-4070TE" by JAPAN VILENE COMPANY, LTD. was used as a polyester fiber substrate ES2.

(6) Glass fiber substrate (GLS)

A woven fabric of glass fiber having a unit weight of 107g/m$^2$ which is sold under a tradename "GC-2I6" by ASAHI-SCHWEBEL COMPANY, LTD. was used as a glass fiber substrate GLS.

(7) First resin RA

First resin RA was made by adding dicyandiamide acting as a curing agent and 2-ethyl-4-methyl imidazole acting as a cure promotor to bisphenol A epoxy resin.

(8) Second resin RB

Second resin RE is flexible epoxy resin which was made by mixing dimer acid modified epoxy resin with the first resin RA so that a resin solid weight ratio of bisphenol A epoxy resin to dimer acid modified epoxy resin is 80:20.

The fiber substrates described above were impregnated with the resins described above according to combinations shown in Table 1 to prepare prepregs 1A to 7. In Table 1, a thickness indicates a thickness of each of the prepregs which were subject to the subsequent heating and pressurizing step. The amount of the resin impregnated in each of the fiber substrates was adjusted so that each of the thicknesses shown in Table 1 may be obtained after the heating and pressuring step.

TABLE 1

| Prepreg | Fiber | Resin | Thickness (mm) |
|---|---|---|---|
| 1A | PA1 | RA | 0.1 |
| 1B | PA1 | RB | 0.1 |
| 1C | PA1 | RA | 0.5 |
| 1D | PA1 | RA | 0.25 |
| 1E | PA1 | RA | 0.17 |
| 2 | PA2 | RA | 0.1 |
| 3 | PA3 | RA | 0.1 |
| 4 | GLS | RA | 0.1 |
| 5 | GLS | RB | 0.1 |
| 6 | ES1 | RA | 0.1 |
| 7 | ES2 | RA | 0.1 |

Then, at least one of the prepregs shown in Table 1 was used to manufacture each of polished-piece holders Examples 1 to 10 and Comparative Examples 1 and 2 described hereinafter.

EXAMPLE 1

Figure 2:
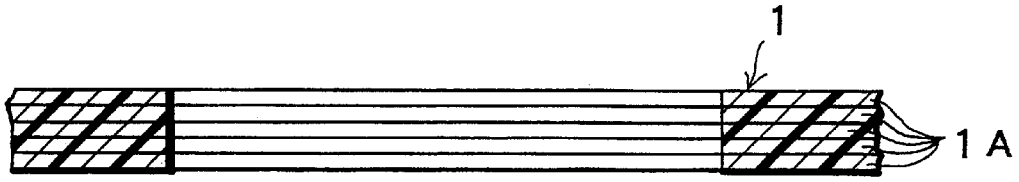
FIG. 2 is a sectional view taken along line II—II of FIG. 1.

FIGS. 1 and 2 show a polished-piece holder 1 which was obtained in Example 1. The polished-piece holder 1 of Example 1 was formed by laminating five prepregs 1A made of the nonwoven aramid fiber substrate. The polished-piece holder 1 was formed into a circular shape of 10 inches (25.4 cm) in diameter and provided on an outer periphery thereof with a gear 2 engaged with both an internal gear and a sun gear of a polishing apparatus (not shown). Also, the polished-piece holder 1 was formed with four through-holes of 3.5 inches (8.9 cm) in diameter in each of which a polished piece in the form of an aluminum hard disc is held. For manufacturing of the polished-piece holder 1 of Example 1, first of all, five prepregs 1A each made by impregnating the nonwoven aramid fiber substrate PA1 with the epoxy resin RA were laminated on each other to provide a rectangular laminate, and then cut into a disc-like laminate. Then, a polypropylene film acting as a release film was arranged on each of both surfaces of the laminate defined in a direction of lamination of the laminate. Then, the laminate was interposedly placed between mirror surfaces of two mirror plates and then two sheets of craft paper layers of 10 mm in thickness were arranged so as to interpose two mirror plates therebetween, followed by arrangement of the laminate in a press platen. Then, the laminate was subject to pressurizing while being heated using the press platen, resulting in providing a single laminate plate of 0.5 mm in thickness. Thereafter, the laminate plate was formed with the gear 2 and through-holes 3, to thereby provide the polished-piece holder 1.

In the polished-piece holder 1 thus obtained, of the five prepregs 1A, the frontmost prepreg 1A and rearmost prepreg 1A were subject to pressuring and heating, to thereby provide a front-side surface layer and a rear-side surface layer constituted of the thermosetting resin impregnated fibrous layer. The remaining three intermediate prepregs 1A were likewise heated and pressurized, to thereby provide three-layer thermosetting resin impregnated fibrous layer constituting a core layer.

EXAMPLE 2

The procedure of Example 1 described above was substantially repeated except that the prepreg 1B was substituted for the prepreg 1A, to thereby obtain a polished-piece holder of Example 2. The polished-piece holder of Example 2 likewise had a thickness of 0.5 mm and was constructed into substantially the same layer structure as that of Example 1.

EXAMPLE 3

Figure 3:
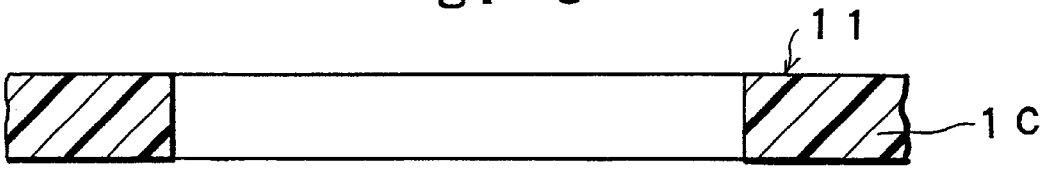
FIG. 3 is a sectional view showing a polished-piece holder of Example 3 of the present invention.

FIG. 3 shows a polished-piece holder 11 which was obtained in Example 3. The polished-piece holder 11 was constituted of a single prepreg 1C made of the nonwoven aramid fiber substrate. The polished-piece holder 11 of Example3 likewise had a thickness of 0.5 mm and manufactured in substantially same procedure as Example 1. In the polished-piece holder 11, the single prepreg 1C was subject to heating and pressurizing, to thereby obtain a thermosetting resin impregnated fibrous layer of a single layer structure. Thus, a front surface of the thermosetting resin impregnated fibrous layer constitutes a surface layer.

EXAMPLE 4

Figure 4:
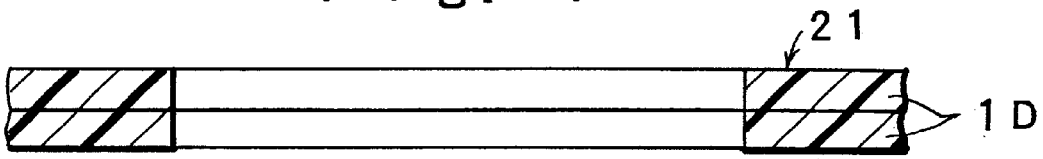
FIG. 4 is a sectional view showing a polished-piece holder of Example 4 of the present invention.

Example 4 was executed to provide a polished-piece holder 21 constructed in such a manner as shown in FIG. 4. The polished-piece holder 21 was constituted by laminating two prepregs 1D made of the nonwoven aramid fiber substrate on each other. The polished-piece holder 21 likewise had a thickness of 0.5 mm and manufactured by substantially repeating Example 1. In Example 4, the prepreg 1D on a front side was subject to heating and pressuring, to thereby provide a thermosetting resin impregnated fibrous layer constituting a surface layer.

EXAMPLE 5

Figure 5:
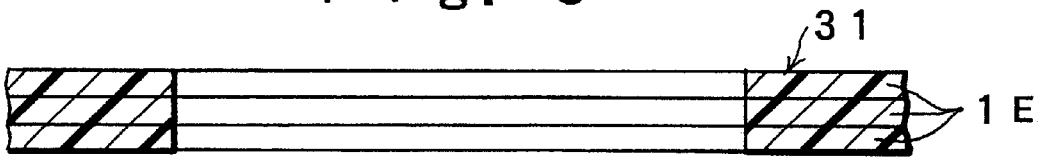
FIG. 5 is a sectional view showing a polished-piece holder of Example 5 of the present invention.

FIG. 5 shows a polished-piece holder 31 which was provided by Example 5. The polished-piece holder 31 was made by laminating three prepregs 1E each formed of the nonwoven aramid fiber substrates on each other. The polished-piece holder 31 of Example 5 likewise had a thickness of 0.5 mm and was manufactured by substantially repeating the procedure described in Example 1. In the polished-piece holder 31, two outer prepregs 1E each were subject to heating to form a thermosetting resin impregnated fibrous layer which constitutes a surface layer and the remaining intermediate prepreg 1E was subject to both heating and pressurizing, resulting in forming a thermosetting resin impregnated fibrous layer which constituting a core layer.

EXAMPLE 6

A polished-piece holder of Example 6 was constructed into substantially the same structure as that of Example 1, except the prepreg 2 was substituted for the prepreg 1A. The polished-piece holder of Example 6 likewise had a thickness of 0.5 mm and was manufactured substantially according to the procedure described in Example 1.

EXAMPLE 7

Example 7 was executed to provide a polished-piece holder constructed into substantially the same structure as that of Example 1, except the prepreg 3 was substituted for the prepreg 1A. The polished-piece holder of Example 7 likewise had a thickness of 0.5 mm and was manufactured by substantially repeating the procedure described in Example 1.

EXAMPLE 8

Figure 6:
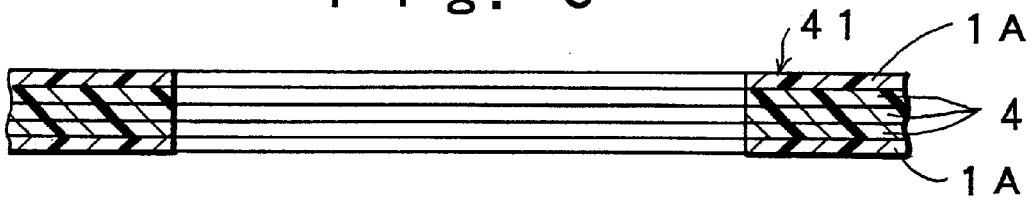
FIG. 6 is a sectional view showing a polished-piece holder of Example 8 of the present invention.

FIG. 6 shows a polished-piece holder 41 which was obtained in Example 8. The polished-piece holder 41 included a core layer and a surface layer laminated on each of both surfaces of the core layer, wherein the core layer was formed by laminating three prepregs 4 made of the glass fiber substrate on each other and the surface layer was made of the nonwoven aramid fiber substrate. The polished-piece holder of Example 8 likewise had a thickness of 0.5 mm and was manufactured by substantially repeating the procedure described in Example 1. In Example 8, three prepregs 4 were subject to heating and pressurizing, to thereby provide a thermosetting resin impregnated fibrous layer of a three-layer structure which constitutes a core layer. The prepreg 1A arranged on each of both surfaces of the core layer was subject to heating and pressurizing to form a thermosetting resin impregnated fibrous layer constituting a surface layer.

EXAMPLE 9

Figure 7:
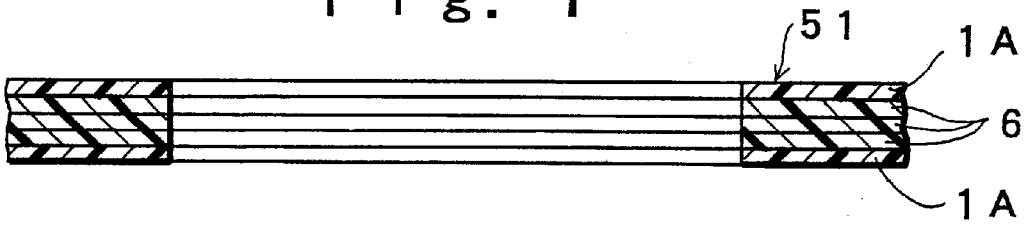
FIG. 7 is a sectional view showing a polished-piece holder of Example 9 of the present invention.

FIG. 7 shows a polished-piece holder 51 which was obtained in Example 9. The polished-piece holder 51 was constituted of a core layer formed by laminating three prepregs 6 made of the polyester fiber substrate on each other and a surface layer formed of the prepreg 1A made of the nonwoven aramid fiber substrate and laminated on each of the core layer. The polished-piece holder of Example 9 likewise had a thickness of 0.5 mm and was manufactured by substantially repeating the procedure described in Example 1. In Example 9, three prepregs 6 were heated and pressurized, to thereby provide a thermosetting resin impregnated fibrous layer of a three-layer structure which constitutes a core layer. The prepreg 1A arranged on each of both surfaces of the core layer was heated and pressurized to form a thermosetting resin impregnated fibrous layer constituting a surface layer.

EXAMPLE 10

A polished-piece holder of Example 10 was constructed into substantially the same structure as that of Example 9, except that a prepreg 7 was substituted for the prepreg 6 to form a core layer. The polished-piece holder of Example 10 likewise had a thickness of 0.5 mm and was manufactured by substantially repeating the procedure described in Example 1.

COMPARATIVE EXAMPLE 1

A polished-piece holder of Comparative Example 1 (prior art) was made by laminating five prepregs 4 formed of the woven glass fiber substrate on each other. The polished-piece holder of the comparative example likewise had a thickness of 0.5 mm and was manufactured by substantially repeating the procedure described in Example 1.

COMPARATIVE EXAMPLE 2

A polished-piece holder of Comparative Example 2 (prior art) was made by laminating five prepregs 5 formed of the woven glass fiber substrate on each other. The polished-piece holder of the comparative example likewise had a thickness of 0.5 mm and was manufactured by substantially repeating the procedure described in Example 1.

Then, the thus-obtained polished-piece holder of each of the examples and comparative examples was subject to a test for considering warpage, a ratio of generation of scratches on a polished piece, the number of times of generation of crush thereof and a life exponent of the polished-piece holder.

The warpage is represented by an average of measured values of maximum raising of 50 polished-piece holder samples of each of the examples and comparative examples from a flat surface of a platen under conditions that a front or rear surface of each of the polished-piece holders was placed on the flat surface of the platen while keeping the front or rear surface of the polished-piece holder contacted with the flat surface of the platen.

The scratch generation ratio, the number of times of generation of crush and the life component were measured in 200 batches of polishing operation carried out under conditions that a sun gear of a polishing apparatus was rotated, leading to planetary movement of the polished-piece holder while keeping the gear of the polished-piece holder engaged with both an internal gear and the sub gear of the polishing apparatus. One batch of polishing operation indicates operation of subjecting a polished piece to polishing while holding four polished pieces on each of the polished-piece holders and subjecting each five polished-piece holders to concurrent planetary motion.

The scratch generation ratio indicates a ratio of the number of polished-piece holders which caused scratches to the total number (4000=4×5×200) of polished-piece holders when they were subject to polishing.

The term "crush" used herein indicates a phenomenon wherein the gear of the polished-piece holder is torn off, and the normal polishing operation can not be done by using the polished-piece holder. The number of times of generation of crush indicates the number of batches on which crush occurred in 200 batches of polishing operation. A thickness of the polished-piece holder is reduced as compared with that of the polished piece, so that vertical force is substantially kept from being applied to the polished-piece holder during polishing. Thus, force in a rotational direction of the polished-piece holder applied to the gear of the polished-piece holder escapingly acts in a vertical direction of the polished-piece holder. This results in tear load being applied to a portion between each adjacent two teeth of the gear of the polished-piece holder in a direction vertical to a flat surface of the polished-piece holder.

The life exponent is judged by means of a degree of wearing of the gear of the polished-piece holder. More particularly, it indicates, in the form of an exponent, the number of polished-piece holders of each of the examples and comparative examples which permit polishing until the gear of the polished-piece holder is worn to a degree sufficient to render the holder unserviceable, supposing that the number of polished-holders of Comparative Example 1 which permit polishing the gear of the polished-piece holder of Comparative example 1 is worn to a degree sufficient to render the holder serviceable is 100. Table 2 shows warpage of each of the polished-piece holder, the ratio of generation of scratches on polished piece, the number of times of generation of crush thereof and the life exponent of the polished-piece holder. Also, Table 2 shows a content of para-aramid fiber in each of examples 1 to 10.

TABLE 2

| | A* | B* | C* | D* | E* |
|---|---|---|---|---|---|
| Example | | | | | |
| 1 | 42.5 | 0.4 | 0 | 0 | 110 |
| 2 | 42.5 | 0.4 | 0 | 0 | 115 |
| 3 | 8.5 | 0.8 | 0 | 0 | 90 |
| 4 | 17.0 | 0.6 | 0 | 0 | 100 |
| 5 | 25.5 | 0.5 | 0 | 0 | 105 |
| 6 | 42.5 | 0.4 | 0 | 0 | 105 |
| 7 | 0 | 0.5 | 0 | i | 95 |
| 8 | 42.5 | 0.2 | 1 | 2 | 100 |
| 9 | 42.5 | 0.2 | 9 | 0 | 95 |
| 10 | 42.5 | 0.3 | 0 | 0 | 93 |
| Comparative Example | | | | | |
| 1 | — | 0.2 | 4 | 7 | 100 |
| 2 | — | 0.2 | 3.5 | 6 | 105 |

A*: pAP content (% by weight)
B*: warpage (mm)
C*: Scratch generation ratio (%)
D*: The number of times of generation of crush
E*: Life exponent Table 2 indicates that the polished-piece holder of each examples 1 to 10 was reduced in warpage, scratch generation ratio and the number of times of generation of crush as compared with that of each of Comparative Examples 1 and 2. Also, the former was increased in serviceable life as compared with the latter.

Also, the polished-piece holder of Example 1 was reduced in moisture absorption and swelling as compared with that of Example 7 using the meta-aramid fiber, resulting in being decreased in dimensional variation during polishing, as compared with that of Example 7. A polishing agent is generally present with water, so that a reduction in moisture absorption of the polished-piece holder is preferable.

The polished-piece holder of Example 2 using the flexible epoxy resin caused both a front surface and an end surface thereof to be softened, leading to an improvement in wear resistance of both surface and gear thereof as compared with that of Example 1.

Further, the polished-piece holder of Example 8 was increased in flexural strength thereof. Thus, it effectively solves a problem that a polished piece fitted in each of the through-holes of the polished-piece holder is removed, to thereby run on the surface of the polished-piece holder.

Moreover, the polished-piece holder of each of Examples 9 and 10 was reduced in warpage because it uses the polyester fiber substrate for the core layer. Also, it escaped generation of scratches and crush. However, the polished-piece holder of each of Examples 9 and 10 caused the core layer to be softened, leading to a deterioration in durability or life. Nevertheless, it will be noted that in view of polished accuracy of a polished piece, the polished-piece holders of Examples 9 and 10 is highly put to practical use although it was deteriorated in durability, because it was reduced in warpage and escaped generation of scratches and crush.

As can be seen from the foregoing, the polished-piece holder of the present invention restrains generation of scratches and crush as compared with the prior art. In particular, use of the nonwoven aramid fiber substrate as the fibrous substrate for the thermosetting resin impregnated fibrous layer in the present invention permits the surface layer to be increased dimensional stability. Also, the present invention prevents a weaving pattern from appearing on the surface of the polished-piece holder even when the surface is worn, resulting in surface roughness of the surface being reduced, leading to uniform flowing of a polishing agent. This prevents a deterioration in polishing accuracy.

What is claimed is:

1. A polished-piece holder comprising-at least one thermosetting epoxy resin impregnated fibrous layer;

said thermosetting epoxy resin impregnated fibrous layer constituting a surface layer and formed by subjecting a prepreg to heating and pressurizing;

said prepreg being made by impregnating a nonwoven fiber aramid substrate with epoxy thermosetting resin, said nonwoven aramid fiber substrate having a para-aramid fiber content of 17% by weight or more.

2. A polished-piece holder as defined in claim 1, wherein said epoxy resin is flexible epoxy resin which exhibits flexibility after curing.

3. A polished-piece holder as defined in claim 1, wherein said para-aramid fiber is poly-p-phenylenediphenyl ether terephthalamide.

4. A polished-piece holder comprising at least one thermosetting epoxy impregnated fibrous layer; said thermosetting epoxy resin impregnated fibrous layer constituting a surface layer and formed by subjecting a prepreg to heating and pressurizing; said prepreg being made by impregnating a nonwoven fiber aramid substrate; said thermosetting epoxy resin layer exhibiting flexibility after curing.

5. A polished-piece holder as defined in claim 3, wherein said aramid fiber substrate mainly consists of para-aramid fiber.

6. A polished-piece holder as defined in claim 5, wherein said para-aramid fiber is poly-p-phenyl ether terepthalamide.

7. A polished piece holder as defined in claim 4, wherein said prepreg is made by impregnating a nonwoven fiber aramid substrate with a thermosetting resin and said layer in which said aramid fiber substrate is contained has a para-aramid fiber content of 17% by weight or more.

* * * * *

UNITED STATES PATENT AND TRADEMARK OFFICE

CERTIFICATE OF CORRECTION

PATENT NO. : 6,291,373 B1
DATED : September 18, 2001
INVENTOR(S) : Sakaguchi et al.

It is certified that error appears in the above-identified patent and that said Letters Patent is hereby corrected as shown below:

Column 9,
Line 21, delete “polished-holders” and insert -- polished-piece holders --.
Line 24, delete “serviceable” and insert -- unserviceable --.
Table 2, Example 7, column D, delete “i” and insert -- 1 --.
Table 2, Example 9, column C, delete “9” and insert -- 0 --.

Column 10,
Line 55, delete “as defined in claim 3” and insert -- as defined in claim 4 --.

Signed and Sealed this

Thirteenth Day of August, 2002

*Attest:*

*Attesting Officer*

JAMES E. ROGAN
*Director of the United States Patent and Trademark Office*